US007010878B1

(12) United States Patent
du Plessis

(10) Patent No.: US 7,010,878 B1
(45) Date of Patent: Mar. 14, 2006

(54) TRIGGER SYSTEM AND METHOD OF INSTALLING SAME

(75) Inventor: Alexander Benjamin du Plessis, Gauteng (ZA)

(73) Assignee: Wilson's Gun Shop, Inc., Berryville, AR (US)

( * ) Notice: Subject to any disclaimer, the term of this patent is extended or adjusted under 35 U.S.C. 154(b) by 0 days.

(21) Appl. No.: 09/546,599

(22) Filed: Apr. 10, 2000

(51) Int. Cl.
*F41A 19/00* (2006.01)

(52) U.S. Cl. ..... 42/69.01; 42/7; 89/33.1

(58) Field of Classification Search ..... 42/69.01, 42/7, 49.01; 89/33.1
See application file for complete search history.

(56) References Cited

U.S. PATENT DOCUMENTS 580,924 A * 4/1897 Browning ..... 89/145
984,519 A * 2/1911 Browning ..... 89/138
3,722,358 A * 3/1973 Seecamp ..... 89/147
4,589,327 A * 5/1986 Smith ..... 89/148
4,862,618 A * 9/1989 Szabo ..... 42/7
5,533,291 A * 7/1996 Boland ..... 42/7
6,164,001 A * 12/2000 Lee ..... 42/69.01
6,253,479 B1 * 7/2001 Fuchs et al. ..... 42/70.02
6,256,918 B1 * 7/2001 Szabo ..... 42/70.08
6,283,006 B1 * 9/2001 Szabo et al. ..... 42/69.03
6,298,594 B1 * 10/2001 Strayer ..... 42/69.01
6,354,032 B1 * 3/2002 Viani ..... 42/42.03

* cited by examiner

*Primary Examiner*—M. Clement
(74) *Attorney, Agent, or Firm*—Arthur G. Yeager

(57) ABSTRACT

A trigger system for an automatic handgun includes a trigger bar sized to be installed in an interior space behind a trigger by movement from the magazine well. The trigger bar is first inserted into the inlet opening of the magazine well and into the interior space which includes a front cavity having a pair of spaced apart upper shoulders and lower shoulders that limit movement of the trigger bar upwardly and forwardly respectively. The interior space further includes a rear cavity that includes a pair of spaced apart lower ledges and a pair of spaced apart rear walls for limiting the rearward and downward movement of the trigger bar. The front cavity is adjacent the trigger and trigger guard. The rear cavity is formed within the handgrip. The trigger system and method is specifically designed for a Colt 1911 .45 pistol with an enlarged magazine well inlet opening for receiving an enlarged stagger magazine.

17 Claims, 5 Drawing Sheets

TRIGGER SYSTEM AND METHOD OF INSTALLING SAME

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

The present invention relates to handgun trigger assemblies and particularly to the method of installation of a trigger and trigger bar.

DESCRIPTION OF RELATED ART

The original frame of the colt 1911 pistol utilizes a trigger and trigger bar that is assembled as a single unit and installed from the rear of the frame. Modifications have been made to the pistol to allow for the use of larger magazines with the result that further modifications had to be made to the standard grip safety. This approach is cumbersome and improvements are therefore needed.

BRIEF SUMMARY OF THE INVENTION

In one aspect of the present invention there is provided a method of installing a trigger bar in an automatic pistol having a magazine well for carrying a magazine and an interior space having means for movably carrying a trigger bar comprising the steps of: inserting a trigger bar into the magazine well; and moving the trigger bar from the magazine well into the interior space and positioning the trigger bar onto the means in the interior space. Other aspects of the present invention include a method of installing a trigger bar and a trigger in an automatic pistol having trigger guard, a magazine well for carrying a magazine, and an interior space communicating with a space within the trigger guard and having a means for movably mounting a trigger bar comprising the steps of: inserting a trigger bar into the magazine well; moving the trigger bar from the magazine well into the interior space and positioning the trigger bar onto the means for movably mounting in the interior space; and attaching a trigger to one end of the trigger bar.

In other aspects of the present invention there is provided a frame for an automatic handgun comprising a trigger guard, a handgrip, a magazine well inside the handgrip having a lower inlet opening for receiving a magazine and a trigger bar in the well and an upper outlet opening, an interior space communicating with the upper outlet opening, a trigger and trigger bar having front and rear portions for operating the firing apparatus of an automatic handgun, means for attaching the trigger to the front portion of the trigger bar. The interior space includes a front cavity adjacent the trigger guard and a rear cavity in the handgrip, each cavity including respective means for movably carrying the trigger bar in the interior space. The rear cavity further includes stop means to limit rearward movement of the trigger bar. The means for movably carrying the trigger bar includes a pair of spaced apart shoulders formed in the rear cavity interior space.

There is also a frame for an automatic handgun comprising a magazine well having a lower inlet opening for receiving a magazine and an upper outlet opening, an interior space communicating with the upper outlet opening for the placement and carrying of a trigger and trigger bar in the space in a manner to provide for cooperative engagement between a trigger and trigger bar and a firing apparatus for a handgun, the interior space being defined by a front cavity including a pair of spaced apart lower shoulders and a pair of spaced apart upper shoulders for limiting movement of a trigger bar forwardly and upwardly respectively in the space during installation of a trigger bar by movement upwardly in the well. The interior space is further defined by a rear cavity, the rear cavity including a pair of spaced apart lower ledges and a pair of spaced apart rear walls for limiting rearward travel of a trigger bar, the magazine well being sized to provide for installation of a trigger bar into the interior space through the inlet opening and through the outlet opening of the magazine well. The interior space is further defined by a pair of spaced apart shoulders extending from a respective upper shoulder in the front cavity to a respective rear wall for limiting upward movement of a trigger bar.

Other aspects of the invention include a frame for a 1911 Colt .45 pistol comprising a magazine well having a lower inlet opening for receiving a magazine and an upper outlet opening, the lower inlet opening being larger than a standard lower inlet opening to receive an enlarged stagger magazine therein, an interior space communicating with the upper outlet opening for the placement and carrying of a trigger and trigger bar in the space in a manner to provide for cooperative engagement between a trigger and trigger bar and a firing apparatus for a handgun, the interior space being defined by a front cavity adjacent a barrel of a handgun, the front cavity including a pair of spaced apart lower shoulders and a pair of spaced apart upper shoulders for limiting movement of a trigger bar forwardly and upwardly respectively in the space during installation of a trigger bar, the interior space further defined by a rear cavity, the rear cavity including a pair of spaced apart lower ledges and a pair of spaced apart rear walls for limiting rearward travel of a trigger bar, the magazine well being sized to provide for installation of a trigger bar into the magazine well through the inlet opening and through the outlet opening into the interior space. The interior space is further defined by a pair of spaced apart shoulders extending from a respective upper shoulder in front cavity to a respective rear wall for limiting upward movement of a trigger bar.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Introduction

The original colt 1911 style staggered stack magazine pistol frame made allowance for the trigger and trigger bar to be assembled as a single unit and to be placed into the frame from the rear of the frame.

In order to allow this and because the trigger bar passed on either side of the magazine of the pistol slots were cut into the frame on either side of the magazine well and this area was then covered at the rear by the pistols' grip safety, which is a separate entity.

Since the original Colt 1911 frame was designed a number of modifications were made whereby, a larger magazine capacity was attained by enlarging the magazine well and using a double stack or staggered stack magazine. Because of the increased width of the magazine the trigger bar also had to be made wider and therefore the normal standard colt style grip safety would not cover the area of the slots in the side of the magazine well. It was therefore necessary to put wings onto the side of the grip safety, which made it cumbersome and untidy.

This present invention entails a modified frame to allow for a stagger magazine but is so designed that the bottom of the magazine well is as wide as the trigger bar, which has to fit around an inserted magazine. This design allows the trigger bar to be fitted in from the bottom of the magazine and therefore allows a standard grip safety to be used because the rear of the frame is still exactly the same as that of an original colt 1911 type frame. This provides for a much neater frame that those frames where the grip safety had to have wings to cover the gaps in the frame required for the trigger bar.

Figure 1:
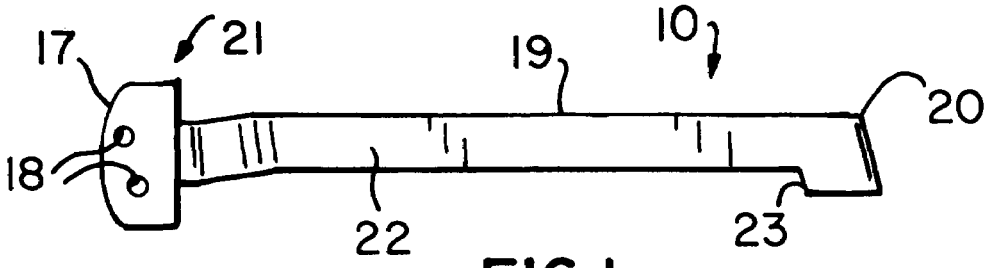
FIG. 1 is an enlarged side elevation view of the trigger bar in accord with the present invention.
Figure 2:
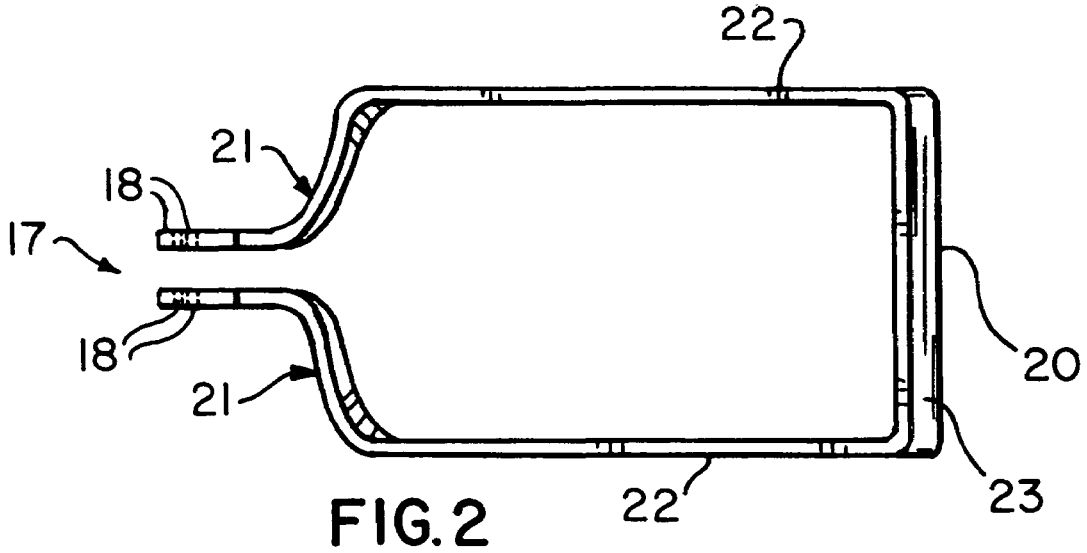
FIG. 2 is a top plan view of the trigger bar of FIG. 1.

Referring now to the drawings, one embodiment of the trigger bar in accord with the present invention is shown at numeral 10 in FIG. 1. The trigger bar 10 includes a front end engaging portion or shoulder 17 made of two front members 21 each including two pin holes 18, a main body 19, a rear member 20, two side members 22, and a rear lip or shoulder 23. In FIG. 2, a top view illustrates the construction that provides that the horizontal spacing between side members 22 is sufficient to accommodate a magazine (shown in broken line) therein.

Figure 3:
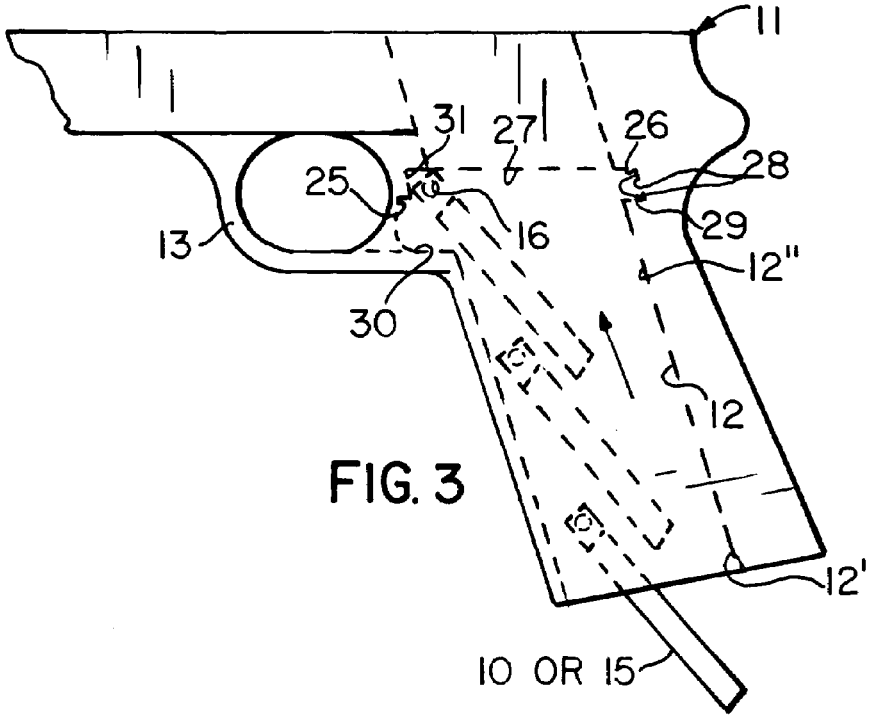
FIGS. 3–10 are pictorial representations of the installation of a second embodiment of the trigger bar in accord with the present invention.
Figure 4:
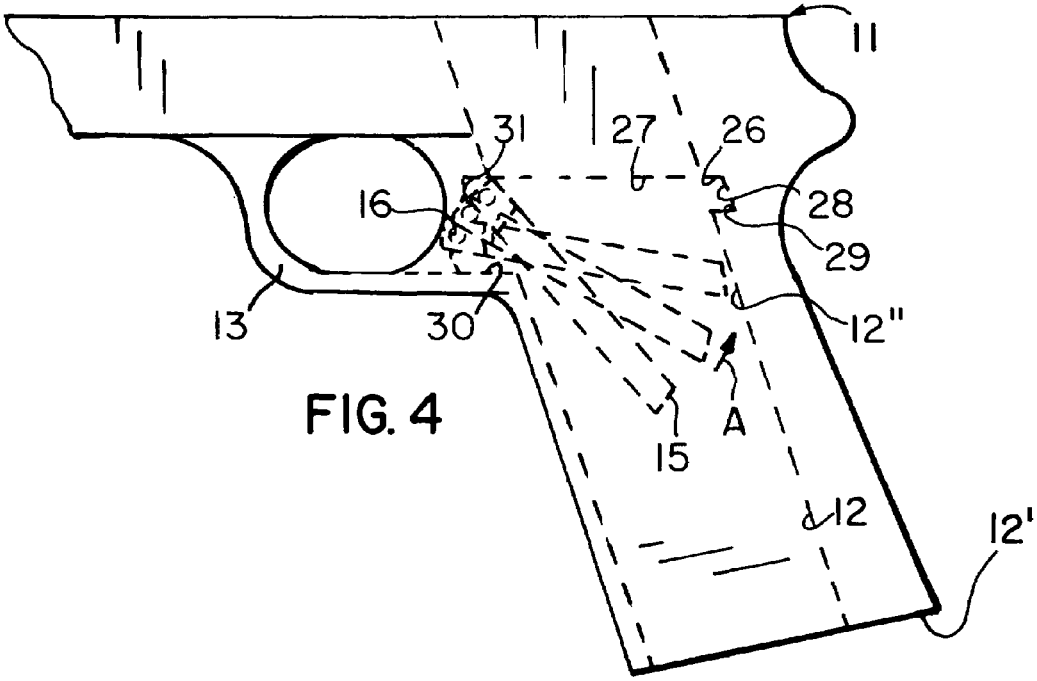
Figure 5:
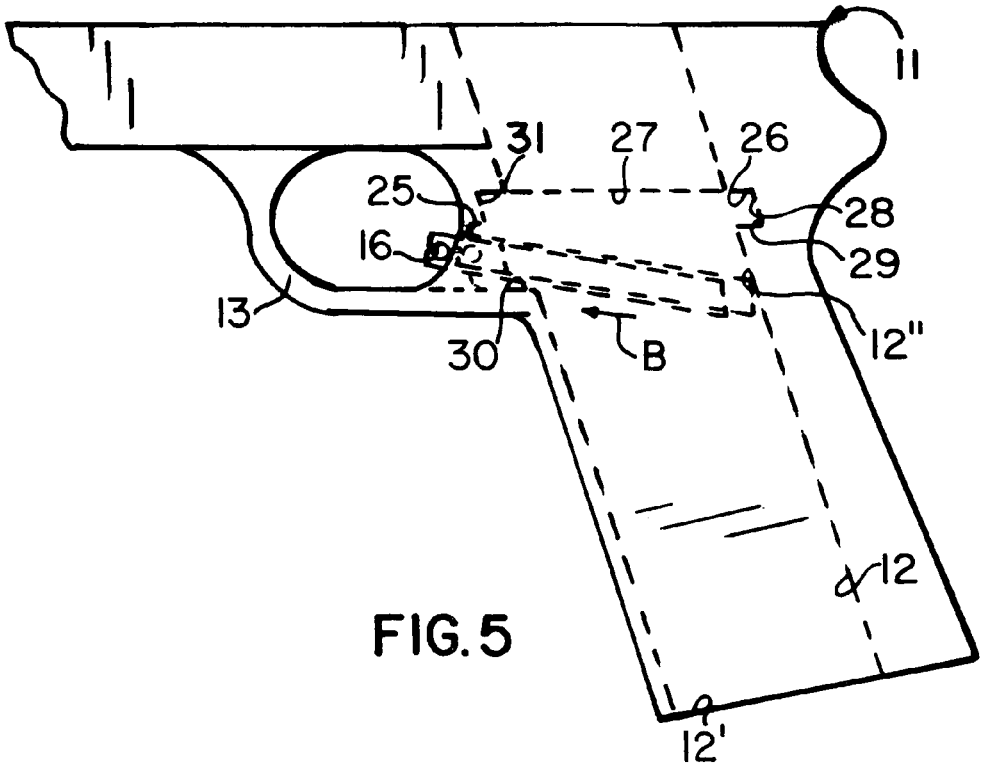
Figure 6:
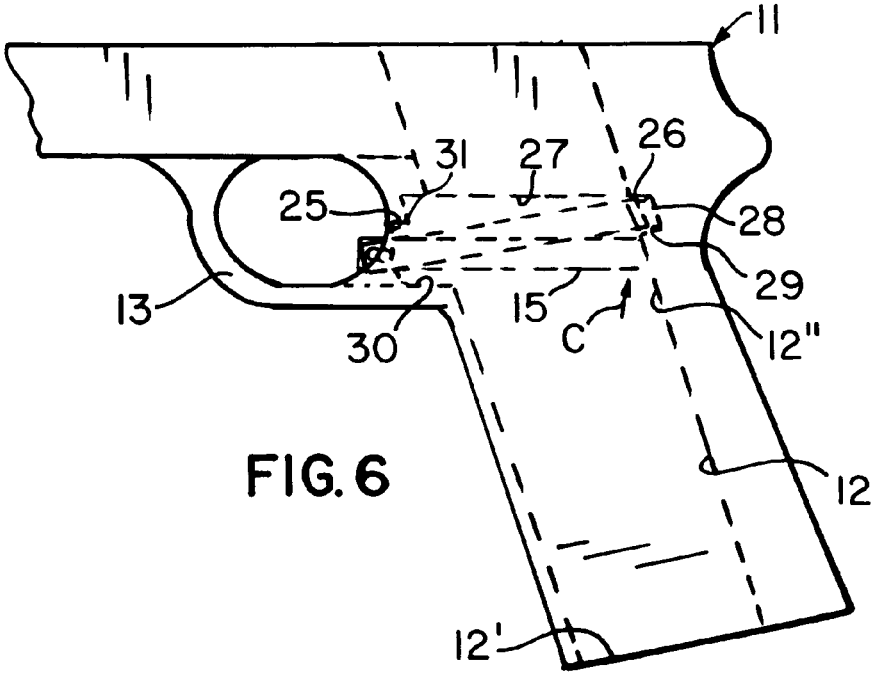
Figure 7:
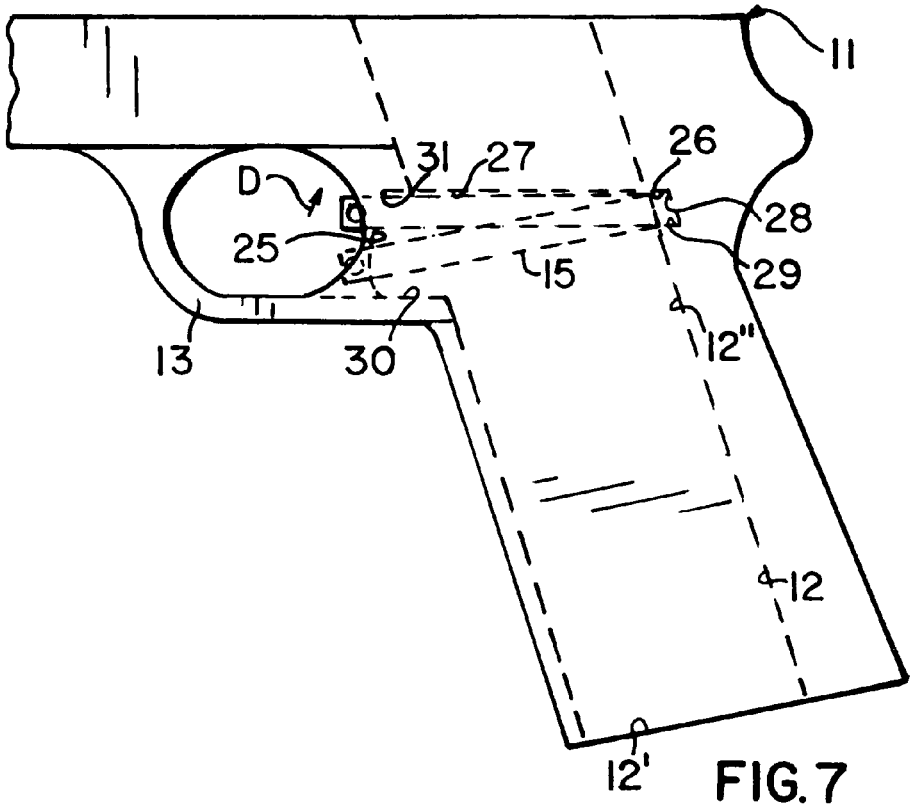
Figure 8:
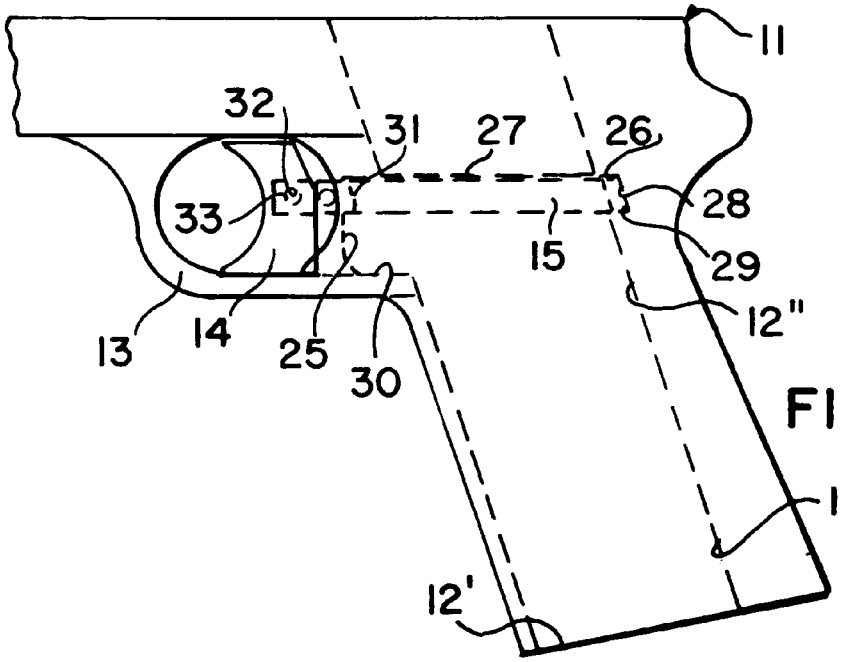
Figure 9:
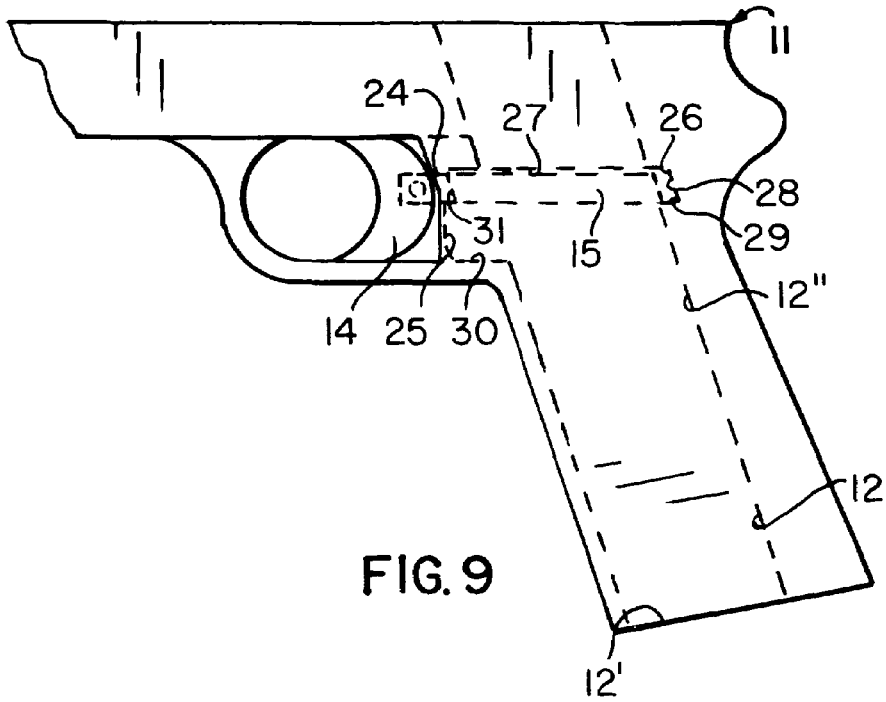
Figure 10:
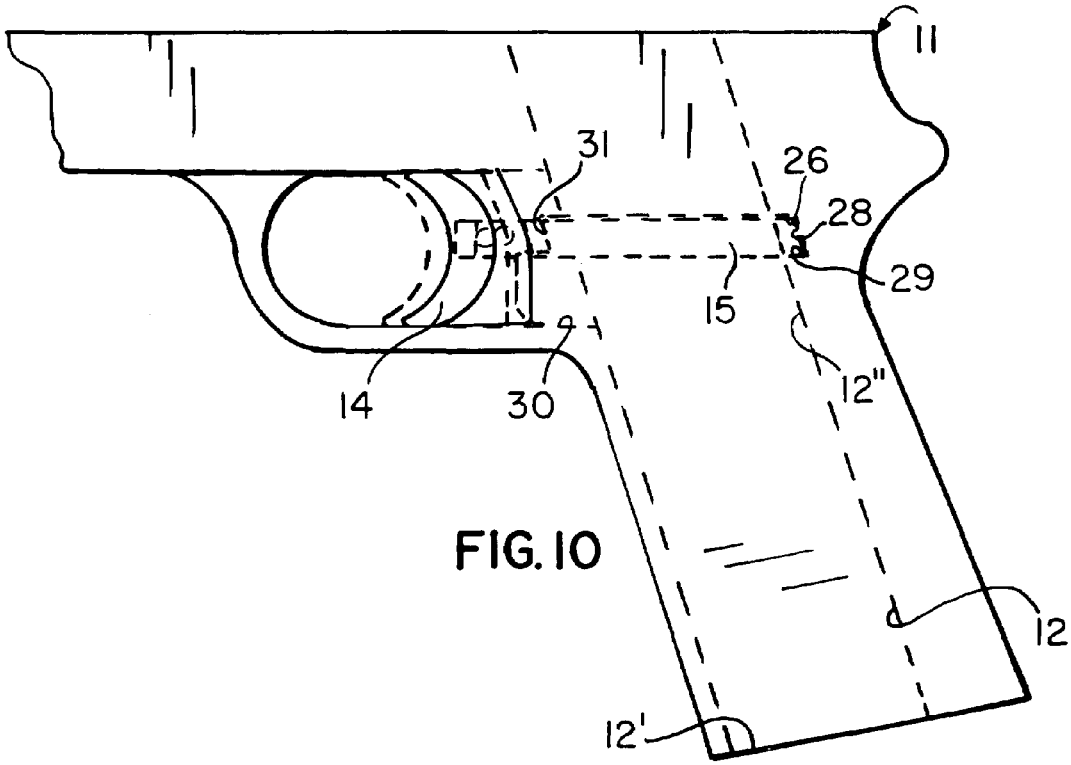

In FIG. 3 a modified colt 1911 pistol frame is shown in outline. Magazine well 12 is modified to carry a stagger magazine. A trigger guard 13 carries a trigger 14 (FIGS. 8–10). For purposes of illustration, an alternate trigger bar 15 having a single pinhole 16 is shown.

A description of the installation of the trigger bar 15 to trigger 14 is as follows.

FIG. 3

The trigger bar 15 is slightly narrower that the bottom part (inlet opening 12') of the magazine well 12 as measured from sides 22. The trigger bar 15 can therefore be pushed in from the bottom up following the arrow A where the magazine well 12 has a pair of space shoulders 27 under which the trigger bar 15 will sit.

FIG. 4

Once the trigger bar 15 is inside the frame 11 it can be rotated counterclockwise so that the front members 21 go into the cavity 25 behind the trigger guard 13 through well outlet opening 12" and is stopped by the frame 11.

FIG. 5

Once the trigger bar 15 is in this position it is pushed forward (arrow B) until the front members 21 come up against the front of the cavity 25. The rear of the trigger bar 15 is now in a position where it can be further rotated upwards as far as the pair of shoulders 27 in the magazine well 12.

FIG. 6

The rear member of trigger bar 15 can rotate upward (arrow C) and into the cavity 26 at the back of the magazine well 12. It can then be pushed backwards into this cavity 26 as shown.

FIG. 7

With the rear of the trigger bar 15 in the cavity 26 at the rear of the magazine well 12, the front members 21 of the trigger bar 15 can be rotated clockwise (arrow D) to a horizontal position so that the trigger bar 15 moves in behind the pair of spaced shoulders 30 in the cavity 25 which then prevents the trigger bar 15 from being able to move sufficiently far forward to allow the rear member 20 of the trigger bar 15 to drop out of the cavity 26.

FIG. 8

With the trigger bar 15 in place and pushed against the pair of spaced shoulders 31, the trigger 14 is then placed in from the side of the trigger guard 13 into the center of the trigger guard 13 and in line with the trigger bar 15.

FIG. 9

The trigger 14 is then pushed backwards allowing the trigger bar 15 to slide into a slot 24 at the back of the trigger 14 until the hole 32 in the trigger 14 lines up with the hole 16 in the trigger bar 15. A pin 33 is then placed through the holes 16, 32 to lock the trigger bar 15 and the trigger 14 together.

FIG. 10

With the trigger bar 15 and trigger 14 pinned together the unit is now free to move back and forth. Rearward movement is controlled by the back of the cavity at a pair of spaced travel limit walls 28 and forward movement by the front of the cavity 25 at upper shoulders 31. Rear ledges 29 limit downward movement of the trigger bar 15. In addition, the forward end of the trigger bar 15 is connected via one or more pins 33 to trigger 14. This feature will also limit downward movement of the trigger bar 15.

A standard frame of a 1911 Colt .45 pistol has been modified by creating a frame 11 made of a combination of stainless steel and Kevlar reinforced polymer. The result is a firearm that is lighter and has a thinner grip portion than the standard model and yet is also capable of carrying a magazine of 10 rounds or larger.

Modifications to the standard 1911 firearm frame include the cavity 25 having a pair of spaced shoulders 30 and a pair of spaced shoulders 31 and rear cavity 26 having spaced upper shoulders 27 extending to a respective shoulder 31 and a pair of spaced apart rear travel limit walls 28 and a pair of spaced apart lower ledges 29.

The slot 24 in trigger 14 is also new. The front engaging portion 17 may include one or more pinholes 18 to match a trigger 14 having one or more pinholes as desired in the circumstances.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A frame for an automatic handgun comprising a trigger guard, a handgrip, a magazine well inside said handgrip having a lower inlet opening sized to accept a stagger magazine having an upper portion in said magazine well including a pair of spaced walls for receiving a stagger magazine and a trigger bar in said well and an upper outlet opening, an interior space communicating with said upper outlet opening, a trigger bar having front and rear portions and a pair of spaced apart side members for operating the firing apparatus of an automatic handgun, said side members being spaced apart a sufficient distance to locate an upper portion of a stagger magazine therebetween, a trigger, means for attaching said trigger to said front portion of said trigger bar, and means for movably carrying said trigger bar in said interior space, said means for movably carrying being located only forwardly and rearwardly of said upper outlet opening, said walls being spaced apart a distance at least equal to the spacing between said side members to allow for the movement of said trigger bar into said lower inlet opening and into said upper outlet opening and into said interior space for mounting said trigger bar therein, said interior space further includes a pair of laterally spaced apart shoulders extending from a respective said upper shoulder in said front cavity to a respective rear wall in said rear cavity for limiting upward travel of said trigger bar.

2. The frame as defined in claim 1 wherein said interior space includes a front cavity adjacent said trigger guard, said means for movable carrying said trigger bar in said interior space including a pair of laterally spaced apart lower shoulders in said front cavity for supporting said trigger bar for sliding movement, and stop means for limiting forward travel of said trigger bar.

3. The frame as defined in claim 2 wherein said means for movably carrying said trigger bar in said interior space further includes a pair of laterally spaced apart upper shoulders in said front cavity for limiting upward travel of said trigger bar.

4. The frame as defined in claim 1 wherein said interior space includes a rear cavity adjacent said handgrip, said means for movably carrying said trigger bar in said interior space including a pair of laterally spaced apart lower ledges in said rear cavity.

5. The frame as defined in claim 4 wherein said rear cavity further includes stop means for limiting rearward travel of said trigger bar.

6. The frame as defined in claim 5 wherein said stop means includes a pair of laterally spaced apart rear walls.

7. The frame as defined in claim 1 wherein said interior space further includes a front cavity adjacent said trigger guard, said front cavity including a pair of laterally spaced apart lower shoulders and a pair of laterally spaced apart upper shoulders for limiting downward and upward movement of said trigger bar in said space.

8. The frame as defined in claim 7 wherein said interior space further includes a rear cavity adjacent said handgrip, said rear cavity including a pair of laterally spaced apart lower ledges for limiting downward travel of said trigger bar.

9. The frame as defined in claim 8 wherein said rear cavity further includes a pair of laterally spaced apart rear walls for limiting rearward travel of said trigger bar.

10. A frame for an automatic handgun comprising a magazine well having a lower inlet opening sized to accept a stagger magazine having an upper portion in said magazine well including a pair of spaced side walls for receiving a magazine and an upper outlet opening, an interior space communicating with said upper outlet opening for the placement and carrying of a trigger and trigger bar having a pair of spaced side members spaced apart a sufficient distance to locate an upper portion of a stagger magazine therebetween in said space in a manner to provide for cooperative engagement between a trigger and trigger bar and a firing apparatus for a handgun, said interior space being defined by a rear cavity and; a front cavity located forwardly of said upper outlet opening including a pair of laterally spaced apart lower shoulders extending only in said front cavity and a pair of laterally spaced apart upper shoulders extending from said rear cavity to said front cavity for limiting movement of a trigger bar forwardly and upwardly respectively in said space during installation of a trigger bar by movement upwardly in said well, said rear cavity located rearwardly of said upper outlet opening, said rear cavity including a pair of laterally spaced apart lower ledges extending only in said rear cavity and a pair of laterally spaced apart rear walls for limiting rearward travel of a trigger bar, said side walls of said inlet opening being spaced apart a distance at least equal to the spacing of said side members to provide for installation of a trigger bar into said interior space through said inlet opening and through said outlet opening of said magazine well for mounting said trigger bar in said interior space between said front cavity and said rear cavity.

11. The frame as defined in claim 10 wherein said interior space is defined by a front cavity, said front cavity including means for movably carrying a trigger bar in said interior space, said means for movably carrying including a pair of laterally spaced apart lower shoulders in said front cavity for limiting forward travel of a trigger bar.

12. The frame as defined in claim 11 wherein said means for movably carrying further includes a pair of laterally spaced apart upper shoulders in said front cavity for limiting upward travel of a trigger bar.

13. The frame as defined in claim 10 wherein said interior space is further defined by a rear cavity, said rear cavity including second means for movably carrying a trigger bar in said interior space, said second means including a pair of laterally spaced apart lower ledges in said rear cavity.

14. The frame as defined in claim 13 wherein said rear cavity further includes stop means for limiting rearward travel of a trigger bar.

15. The frame as defined in claim 14 wherein said stop means includes a pair of laterally spaced apart rear walls.

16. The frame as defined in claim 10 wherein said interior space is further defined by a pair of laterally spaced apart shoulders extending from a respective said upper shoulder in said front cavity to a respective rear wall in said rear cavity for limiting upward travel of a trigger bar.

17. A frame for an automatic handgun comprising a magazine well having a lower inlet opening sized to accept a stagger magazine having an upper portion in said magazine well including a pair of spaced side walls for receiving a magazine and an upper outlet opening, said lower inlet opening sized to receive an stagger magazine therein, an interior space communicating with said upper outlet opening for the placement and carrying of a trigger and trigger bar having a pair of spaced side members spaced apart a sufficient distance to allow an upper portion of a stagger magazine to be located therebetween in said space in a manner to provide for cooperative engagement between a trigger and trigger bar and a firing apparatus for a pistol, said interior space being defined by a rear cavity and; a front cavity adjacent a barrel of a pistol forwardly of said upper outlet opening, said front cavity including a pair of laterally spaced apart lower shoulders extending only in said front cavity and a pair of laterally spaced apart upper shoulders extending between said cavities; for limiting movement of a trigger bar forwardly and upwardly respectively in said space during installation of a trigger bar, said rear cavity located rearwardly of said upper outlet opening, said rear cavity including a pair of laterally spaced apart lower ledges extending only in said rear cavity and a pair of laterally spaced apart rear walls for limiting rearward travel of a trigger bar, said sidewalls of said inlet opening being spaced apart a distance at least equal to the spacing between said side members to provide for installation of a trigger bar into said magazine well through said inlet opening and through said outlet opening into said interior space for slidably mounting said trigger bar in said front cavity and said rear cavity.

* * * * *